United States Patent [19]

Nakato et al.

[11] Patent Number: 4,508,571

[45] Date of Patent: Apr. 2, 1985

[54] MOLD ADDITIVES FOR USE IN CONTINUOUS CASTING

[75] Inventors: Hakaru Nakato; Toshikazu Sakuraya; Yasuhiro Habu; Toshihiko Emi, all of Chiba; Masanori Kodama, Kurashiki; Takao Koshikawa, Chiba; Yoshimitsu Yoshida; Fumitaka Shimokawa, both of Kobe, all of Japan

[73] Assignees: Kawasaki Steel Corporation; Sakai Chemical Industry Co., Ltd, both of Kobe, Japan

[21] Appl. No.: 591,030

[22] Filed: Mar. 19, 1984

[30] Foreign Application Priority Data

Aug. 10, 1983 [JP] Japan ..... 58-145102

[51] Int. Cl.[3] ..... B28B 7/34

[52] U.S. Cl. ..... 106/38.28; 75/96; 106/38.27; 164/123; 164/472; 164/473

[58] Field of Search ..... 106/38.27, 38.28; 164/472, 473, 123; 75/96

[56] References Cited

U.S. PATENT DOCUMENTS 3,964,916 6/1976 Armistead et al. ..... 106/38.28

4,102,690 7/1978 Koper ..... 106/38.28

*Primary Examiner*—Lorenzo B. Hayes

*Attorney, Agent, or Firm*—Balogh, Osann, Kramer, Dvorak, Genova & Traub

[57] ABSTRACT

A mold additive for use in the continuous casting is disclosed, which comprises a base material for slag having a chemical composition of $CaO—SiO_2—Al_2O_3$ system, a flux and a carbonaceous aggregate. The mold additive contains 0.5–2.0% by weight of carbon black and 1–4% by weight of activated carbon with an average particle size of not more than 10 μm as the carbonaceous aggregate, and has a bulk density of not more than 0.9 g/cm$^3$.

5 Claims, 4 Drawing Figures

MOLD ADDITIVES FOR USE IN CONTINUOUS CASTING

This invention relates to a mold additive (hereinafter referred to as mold powder) for use in the continuous casting. More specifically, the invention relates to an improvement on the melting characteristics of the mold powder for effectively preventing the occurrence of surface defects of the continuously cast slab in the continuous casting.

In the continuous casting, the mold powder added onto the surface of molten steel in a mold is melted by heat supplied from molten steel, which is poured into the mold underneath the molten steel surface through a submerged nozzle, to form a molten slag layer.

The molten slag layer not only prevents the oxidation of the molten steel surface by air, but also absorbs the impurities floating from the molten steel. At the same time, it flows into a boundary between the mold and the continuously cast slab and serves as a supply source for slag film giving a lubricating action in the withdrawing of the continuously cast slab.

If the thickness of the molten slag layer is too large, the flowing of the slag film becomes excessive. Further, if the thickness of the molten slag layer becomes locally larger due to the local rapid melting of the mold powder in the mold, the ununiform flowing of the slag film is induced.

The excessive or ununiform flowing of the slag film interrupts the heat transfer from molten steel to the cooling water in the mold, and causes the local delay in solidification to produce surface defects such as longitudinal cracks, corner cracks and the like, and in the worst case, the break-out is induced to obstruct the stable continuous casting.

Therefore, the mold powder is required to possess such melting characteristics that the resulting molten slag layer is uniformly maintained at an appropriate thickness on the molten steel surface.

As the mold powder, there have hitherto been used a mold powder consisting of a base material having a chemical composition of $CaO—SiO_2—Al_2O_3$ system for slag and a flux added to adjust the melting point and viscosity of the base material and composed of at least one substance selected from fluorides and carbonates of alkali metals or alkaline earth metals and containing several percent of a carbonaceous aggregate, or granulates obtained by adding an organic or inorganic binder to the above mold powder and then granulating them.

In the conventional mold powders, however, it was confirmed through investigation that the blending criterion of the carbonaceous aggregate added to mainly adjust the melting rate is utterly qualitative and does not reflect the actual situation.

That is, the evaluation of the melting characteristics has been conventionally performed by measuring a complete melting time on a relatively small amount of the mold powder under unsteady heating conditions, i.e. at a set heating rate up to a set temperature. On the other hand, the melting of the mold powder in the actual mold substantially proceeds virtually under steady heating conditions except in the initial casting stage, which is actually inappropriate for the above evaluation. Particularly, it is impossible to judge the uniformity with respect to the thickness of the molten slag layer on the molten steel surface in the mold and further the thickness of the slag film over the inner peripheral surface of the mold by the evaluation method as described above.

As to the addition of the carbonaceous aggregate, therefore, there has been vigorously set only such a practically useless addition range of the carbonaceous aggregate that at least one of carbon black, graphite and coke dust is added in an amount of 1 to 10%.

The research group including the inventors have previously aimed at a point that the aforementioned evaluation method of the melting characteristics mainly intends the adjustment of the melting rate as mentioned above and is hardly suitable for the actual situation of the continuous casting operation, and made various studies with respect to the optimum addition range of the carbonaceous aggregate based on the actual experiences in the continuous casting operation, and as a result it has been confirmed that the case where carbon black and coarse carbon powder having an average particle size of not less than 1 $\mu$m are incorporated in an amount of 0.4–0.9% by weight and in an amount of more than 1.0% by weight but not more than 5.0% by weight into the whole mold powder, respectively (see Japanese Patent Application Publication No. 57-24,048).

In this case, however, the incorporation of carbon black and coarse carbon powder is effective for the reduction in the longitudinal crack of the slab for thick plate, the slag inclusion of the slab for sheet and the like, but it may be difficult to realize the optimum melting characteristics depending upon the kind and particle size of the coarse carbon powder to be used together with carbon black. In addition, it has been newly found that the above incorporation is accompanied with an ill effect of carburizing the surface of the continuously cast steel. For these reasons, the incorporation of carbon black and coarse carbon powder into the mold powder is particularly revealed to come into question in the casting of extremely low carbon steels and the like.

Meanwhile, it is considered that the carburizing phenomenon due to the mold powder containing the carbonaceous aggregate is produced by the direct contact between the carbon of the mold powder and the molten steel, or the contact between the molten steel and the carbon suspend in the molten slag. Accordingly, it has been attempted to reduce the amount of the carbonaceous aggregate in the mold powder. However, such an attempt can except only the reduction of the carburizing, but is obviously disadvantageous in view of the control on the melting rate and the melted state of the mold powder, and further degrades the heat insulating property, so that the effect for decreasing the slag inclusion, accumulation of inclusions beneath the surface layer and facial crack becomes insufficient.

In order to solve the above problem, there have been proposed a method of using a nitride such as BN, $Si_3N_4$ instead of the carbonaceous aggregate, or a method of using the nitride together with a small amount of the carbonaceous aggregate, or a method of using a carbonate instead of the carbonaceous aggregate, or the like. However, these methods have still some troubles and are impractical for the following reasons.

More specifically, in the method of using the nitride, it is converted to an oxide at a relatively earlier melting stage, for instance, according to the following reaction formula:

$$4BN+3O_2 \rightarrow 2B_2O_3+2N_2 \uparrow$$

and the resulting $B_2O_3$ instantly reacts with the base material for slag. As a result, the use of the nitride cannot substantially expect the natural function as an aggregate, i.e. the effect for controlling the melting by preventing the fusing between particles of the mold powder, and increases the cost as compared with the use of the carbonaceous aggregate.

On the other hand, the carbonate is not sufficient in the aggregation action as compared with free carbon, and dust is apt to be produced due to $CO_2$, CO gas generated in the thermal decomposition of the carbonate. Further, since the decomposition reaction is endothermic, the intended purpose of the mold powder for thermally insulating the molten steel is deteriorated.

Based on the drastic investigation on the carburizing mechanism in order to realize appropriate melting characteristics required for the mold powder without being suffered from the disadvantages inevitably appeared in the countermeasures as described above and without causing the carburizing phenomenon, an object of the invention is to provide a novel mold powder having a good thermal insulating property suitable for use in the continuous casting for slabs and blooms.

The inventors have made various studies on the carburizing mechanism in connection with the above object and found that the carburizing is caused due to the fact that the concentrated free carbon remaining on the molten slag and the carbon kept at an insufficient oxidized state in a sintered layer, which is formed by heating the charged mold powder on the molten slag layer, get a chance to contact with molten steel by suspension and diffusion into the molten slag.

In order to prevent the carburizing, it is effective to prevent the formation of the concentrated free carbon layer on the molten slag and to control the sintering of the added mold powder so as to eliminate the excessive formation of the sintered layer keeping carbon therein.

By the way, the concentrated free carbon is produced on the molten slag by liberating carbon having a low oxidation consumption rate from the mold powder at an incomplete combustion stage. In order to prevent the formation of the free carbon, therefore, it is important to employ carbons having a high oxidation consumption rate and to maintain these carbons in an oxidizing atmosphere.

On the other hand, it is also important to appropriately select the kind of the carbon for preventing the sintering of the added mold powder.

The invention will now be described in detail with reference to the accompanying drawings, wherein.

Figure 1:
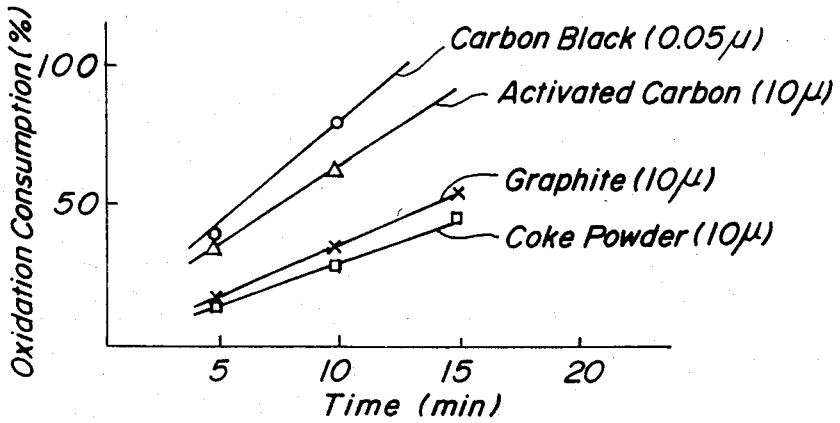
FIG. 1 is a graph showing the change of oxidation consumption of various carbon powders with the lapse of time.

At first, the oxidation consumption rates of various carbon powders were actually measured at 1,300° C. in air to obtain results as shown in FIG. 1.

From FIG. 1, it is understood that carbon black and activated carbon are liable to be consumed through oxidation as compared with graphite and coke powder.

Figure 2:
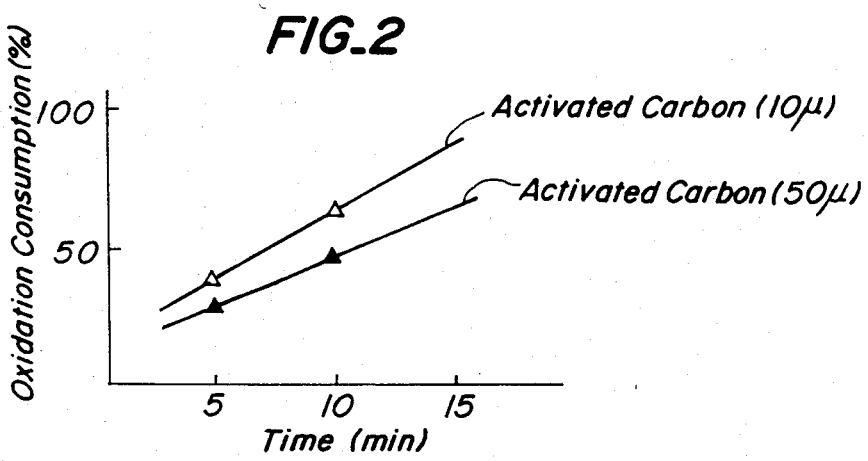
FIG. 2 is a graph showing the influence of particle size of activated carbon upon the relation between the oxidation consumption and the time.

Then, it was confirmed through further investigations on the activated carbon that as shown in FIG. 2, the smaller the particle size of the activated carbon, the larger the oxidation consumption rate.

Although the particle size of the activated carbon is fairly larger than that of carbon black, the activated carbon has a feature that the oxidation consumption rate is high.

In this experiment, the carbon black used has a particle size of 0.01–0.05 μm and a specific surface area of 50–240 $m^2/g$.

Figure 3:
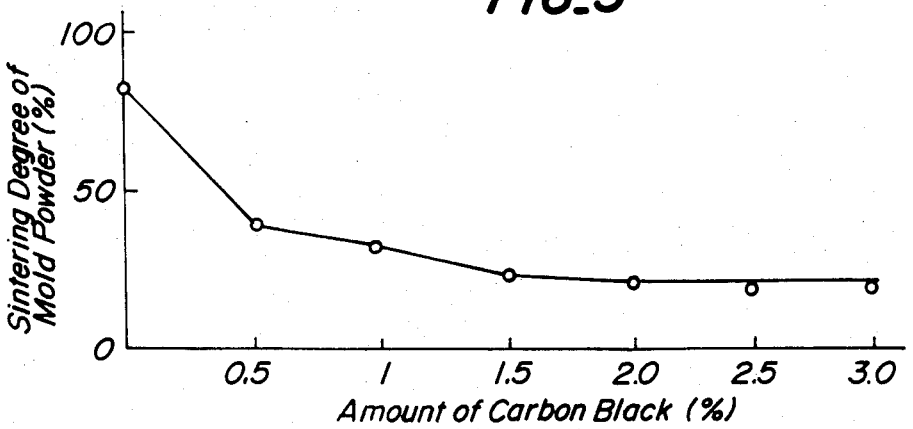
FIG. 3 is a graph showing the influence of amount of carbon black upon the sintering degree of the mold powder.

A sintering degree of a mold powder consisting of a base material for slag having a chemical composition of 35%CaO—35%$SiO_2$—5%$Al_2O_3$ and containing 20% of sodium fluoride as a flux was measured by changing the addition amount of carbon black to obtain a result as shown in FIG. 3. From FIG. 3, it is obvious that when the amount of carbon black is not less than 0.5%, the sintering of the mold powder becomes smaller and the effect of preventing the sintering is large in the amount of up to 2.0%.

The reason why the carbon black largely develops the effect of preventing the sintering of the mold powder is due to the fact that the carbon black has an extremely small particle size and covers the mold powder particles so as to prevent the agglomeration of the particles.

If the amount of carbon black is less than 0.5%, it is difficult to prevent the sintering of the mold powder, while if it exceeds 2%, it is difficult to observe the surface of molten steel due to the occurrence of dusts and the flaming, so that the amount of carbon black is restricted to 2% mainly from the standpoint of the workability.

As mentioned above, the carbon black is effective in the prevention of the mold powder sintering, but is disadvantageous in the thermal insulating property because the carbon black is fast in the oxidation rate and the melting of the mold powder becomes too fast even when the carbon black is added in a proper amount of not more than 2% alone. The activated carbon effectively contributes to compensate for the above disadvantage of the carbon black as follows.

That is, since the activated carbon has a particle size larger than that of the carbon black, it is remarkable in the effect as an aggregate and effectively controls the melting rate of the mold powder to prevent the excessively fast melting of the mold powder and to improve the thermal insulation property.

Despite of the above, since the activated carbon is high in the oxidation consumption rate as compared with the graphite and coke powder, it scarcely remains unburned as free carbon.

The activated carbon is produced by carbonizing a starting material such as wood, coconut shell, brown coal, coal or the like and then subjecting to an activation treatment. Activated carbons produced from the coconut shell, coal and the like by steam-activation and having an inner specific surface area of 1,000–3,000 $m^2/g$ are advantageously suitable for the invention. Among them, activated carbon having an average particle size of about 10 μm is particularly suitable for the object of the invention on the oxidation consumption rate as shown in FIGS. 1 and 2.

When the average particle size exceeds 10 μm, however, there is a high possibility that the activated carbon remains as the residual carbon though the oxidation consumption rate is fairly high as previously mentioned, so that such activated carbon is not suitable in view of the prevention of the carburizing.

When the amount of the activated carbon is less than 1% it is ineffective in the improvement of melting characteristics and it is difficult to sufficiently ensure the thermal insulating property of the mold powder. On the other hand, when it exceeds 4%, the melting of the mold powder is rather slower and the activated carbon remains unburned to cause the carburizing.

Based upon the above knowledges, the inventors have found that the formation of the concentrated free carbon and the sintering of the mold powder on the molten slag are almost suppressed by using 0.5 to 2.0% of carbon black together with 1 to 4% of activated carbon having an average particle size of not more than 10 μm, whereby the carburizing of molten steel can effectively be prevented.

Figure 4:
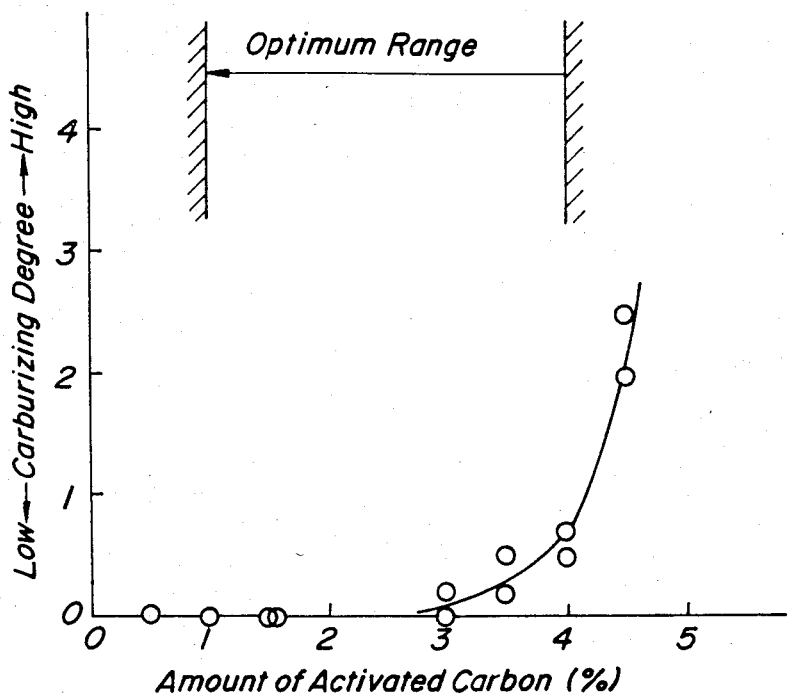
FIG. 4 is a graph showing the influence of amount of activated carbon upon the carburizing degree.

FIG. 4 shows the relation between the amount of activated carbon in the mold powder and the carburizing degree on the cast slab surface of the extremely low carbon steel with holding the effect of carbon black for preventing the sintering of the mold powder added onto the molten steel surface in the mold. The mold powder used in FIG. 4 was composed of 94–98 parts by weight of a mixture of base material for slag and flux consisting of 56% of vitreous calcium silicate, 22% of blast furnace slag (water granulated), 11% of silica flour and 17% of cryolite, and 1.5 parts by weight of carbon black as an aggregate and 0.5–4.5 parts by weight of activated carbon as an aggregate added so as to make the total weight to 100.

If the amount of the activated powder is less than 1.0%, the melting rate of the mold powder added onto the molten steel surface becomes very fast, so that an unmelted layer of the mold powder with an appropriate thickness is not formed on the molten steel surface. For this reason, the thermal insulating property is poor and the solidified steel cluster called as "Deckel" is formed on the surface of molten steel.

If the amount of activated carbon exceeds 4%, the carburized portion on the surface of the cast slab rapidly increases. That is, the optimum range of activated carbon contained in the mold powder according to the invention is 1–4%.

In order for carbon black and activated carbon to sufficiently exhibit the above effects and to prevent the sintering of the mold powder to the utmost, it is premised that the mold powder comprises a base material for slag having a chemical composition of $CaO—SiO_2—Al_2O_3$ system and at least one flux selected from the group consisting of fluorides and carbonates of alkali metals and alkaline earth metals.

The base material for slag may include $CaO—SiO_2—Al_2O_3$ mineral composition systems consisting of 39–46% of CaO, 40–56% of $SiO_2$ and 2–15% of $Al_2O_3$. As the flux, mention may be made of $CaF_2$, $BaF_2$, NaF, LiF, $Na_2CO_3$, $K_2CO_3$, $Li_2CO_3$, $CaCO_3$, $BaCO_3$ and the like. In this case, at least one flux selected from these fluorides and carbonates is used in an amount of 5–30% in total.

As is well-known, the base material for slag forming the above mineral composition may be used by properly blending Portland cement, fly ash, silica flour, vitreous calcium silicate, soda glass, and blast furnace slag (water granulated) and the like.

The above base material may be used as it is in the form of a powdery mixture together with the flux and cabonaceous aggregate, but it is required to have a bulk density of not more than 0.9 g/cm³. If the bulk density exceeds 0.9 g/cm³, the time required for completely burning carbon becomes longer, so that free carbon remains in the mold powder.

The bulk density of the mold powder is measured as follows.

The powdery or granular mold powder is naturally dropped into a cylindrical vessel having an inner diameter of 50 mm and a volume of 100 cm³ from a height of not more than 50 mm above the top end of the vessel. After the dropping is effected with a slightly excess amount of the mold powder than 100 cm³, a sample is taken out in an amount of 100 cc to measure the weight thereof.

The constitutions of the mold powder satisfying the objects aimed at by the invention are summarized as follows.

The mold powder for use in continuous casting composed of a base material for slag having a chemical composition of $CaO—SiO_2—Al_2O_3$ system, a flux composed of at least one substance selected from the group consisting of fluorides and carbonates of alkali metals and alkaline earth metals, and a carbonaceous aggregate as a melting rate adjuster, is characterized in that carbon black and activated carbon having an average particle size of not more than 10 μm are added as the carbonaceous aggregate in amounts of 0.5–2.0% by weight and 1–4% by weight, respectively, to the mold powder, and that the bulk density of the mold powder is not more than 0.9 g/cm³.

As regards the base material and flux, it is preferable that at least 60% of a mixture of the base material and the flux is preliminarily melted and pulverized and then mixed with the remaining portion of the mixture.

Particularly, since the fluoride and/or the carbonate act also as viscosity adjusting agents, when all or a part of the fluoride and/or carbonate are mixed with the base material for slag having a chemical composition of $CaO—SiO_2—Al_2O_3$ system and the resulting mixture is melted, cooled and granulated, the softening and melting temperatures of the resulting mold powder can be adjusted more advantageously.

Further, it is possible to adjust the properties of the mold powder by further adding FeO, MnO, MgO or the like while substantially maintaining the main components.

The following examples are given in illustration of the invention and are not intended as limitations thereof.

The continuous casting for an extremely low carbon steel was carried out by using a mold powder as shown in the following Tables 1 and 2 under such conditions that the temperature of molten steel was 1,540°–1,560° C., the size of cast slab was 230 mm × 1,000 ~ 1,300 mm and the casting speed was 1.2 ~ 1.6 m/min, during which the heat insulation on molten steel surface in a mold, the carburizing degree and the index of slag inclusion were evaluated to obtain results as shown in Tables 1 and 2. Moreover, Portland cement, fly ash, silica flour, vitreous calcium silicate, soda glass and blast furnace slag (water granulated), each having a chemical composition as shown in the following Table 3, were used in the base material for slag, respectively.

TABLE 1(a)

| | Example | | | | | | |
|---|---|---|---|---|---|---|---|
| | 1 | 2 | 3 | 4 | 5 | 6 | 7 |
| Base material | | | | | | | |

TABLE 1(a)-continued

| | Example | | | | | | |
|---|---|---|---|---|---|---|---|
| | 1 | 2 | 3 | 4 | 5 | 6 | 7 |
| for slag | | | | | | | |
| Portland cement | 47 | 47 | 44 | 47 | | | |
| fly ash | 23 | 23 | 16 | 18 | | | |
| silica flour | 10 | 10 | 15 | 15 | 10 | 15 | 10 |
| vitreous calcium silicate | | | | | 50 | 34 | |
| soda glass | | | | | | | 10 |
| blast furnace slag | | | | | 20 | 30 | 59 |
| Flux | | | | | | | |
| fluorite | 10 | | 5 | | | 10 | |
| soda ash | 5 | | 5 | | | 5 | |
| cryolite | | | 10 | 5 | 15 | | |
| sodium fluoride | | 15 | | 10 | | | 15 |
| calcium carbonate | | | | | | | |
| Carbonaceous aggregate | | | | | | | |
| carbon black | 1 | 2 | 1.5 | 0.5 | 1 | 2 | 2 |
| activated carbon | 3 | 2 | 3.5 | 4 | 4 | 4 | 4 |
| (particle size, μm) | (8) | (5) | (3) | (2) | (8) | (5) | (5) |
| Bulk density (g/cm$^3$) | 0.80 | 0.80 | 0.75 | 0.75 | 0.80 | 0.75 | 0.80 |
| Heat insulation on molten steel surface in mold | good | good | good | good | good | good | good |
| Carburizing degree | 0 | 0 | 0.05 | 0 | 0 | 0 | 0 |
| Index of slag inclusion | 0 | 0 | 0 | 0 | 0 | 0 | 0 |
| Remarks | good | good | good | good | good | good | good |

TABLE 1(b)

| | Example | | |
|---|---|---|---|
| | 8 | 9 | 10 |
| Base material for slag | | | |
| Portland cement | | | |
| fly ash | | | |
| silica flour | | | 15 |
| vitreous calcium silicate | 80 | | 45 |
| soda glass | | 10 | |
| blast furnace slag | | 70 | 20 |
| Flux | | | |
| fluorite | | 10 | |
| soda ash | | | |
| cryolite | 15 | | 10 |
| sodium fluoride | | 5 | |
| calcium carbonate | | | 5 |
| Carbonaceous aggregate | | | |
| carbon black | 1.5 | 2 | 1 |
| activated carbon | 3.5 | 3 | 4 |
| (particle size, μm) | (3) (granule) | (3) (granule) | (8) |
| Bulk density (g/cm$^3$) | 0.80 | 0.80 | 0.80 |
| Heat insulation on molten steel surface in mold | good | good | good |
| Carburizing degree | 0 | 0 | 0 |
| Index of slag inclusion | 0 | 0 | 0 |
| Remarks | good | good | good |

TABLE 1(c)

| | Reference Example | | |
|---|---|---|---|
| | 1 | 2 | 3 |
| Base material for slag | | | |
| Portland cement | 47 | | |
| fly ash | 24 | | |
| silica flour | 10 | 10 | 10 |
| vitreous calcium silicate | | 50 | 51 |
| soda glass | | | |
| blast furnace slag | | 20 | 21 |
| Flux | | | |
| fluorite | | | |
| soda ash | | | |
| cryolite | | 15 | 15 |

TABLE 1(c)-continued

| | Reference Example | | |
|---|---|---|---|
| | 1 | 2 | 3 |
| sodium fluoride | 15 | | |
| calcium carbonate | | | |
| Carbonaceous aggregate | | | |
| carbon black | 0.5 | 1 | [illegible] |
| activated carbon | 4 | 4.5 | [illegible].5 |
| (particle size, μm) | (20) | (8) | (8) |
| Bulk density (g/cm$^3$) | 0.80 | 0.80 | 0.80 |
| Heat insulation on molten steel surface in mold | good | good | Deckel formed |
| Carburizing degree | 1.5 | 2.0 | [illegible] |
| Index of slag inclusion | 0.2 | 0 | [illegible].0 |
| Remarks | Particle size of activated carbon was unsuitable Carburizing occurred | Amount of activated activated carbon was large Carburizing occurred | Amount of carbon was small Large slag inclusion |

TABLE 1(d)

| | Reference Example | |
|---|---|---|
| | 4 | 5 |
| Base material for slag | | |
| Portland cement | | |
| fly ash | | |
| silica flour | [illegible]0 | [illegible]0 |
| vitreous calcium silicate | [illegible]0 | [illegible]0 |
| soda glass | | |
| blast furnace slag | [illegible]0 | [illegible]0 |
| Flux | | |
| fluorite | | |
| soda ash | | |
| cryolite | [illegible]5 | [illegible]5 |
| sodium fluoride | | |
| calcium carbonate | | |
| Carbonaceous aggregate | | |
| carbon black | [illegible] | [illegible]2.5 |
| activated carbon | 4 | [illegible] |
| (particle size, μm) | [illegible]5) | [illegible]8) |
| Bulk density (g/cm$^3$) | [illegible].80 | [illegible].80 |
| Heat insulation on molten steel surface in mold | Deckel formed | good |
| Carburizing degree | [illegible] | [illegible].0 |
| Index of slag inclusion | 4.0 | [illegible].5 |
| Remarks | Amount of carbon black was unsuitable Large slag inclusion | Amount of carbon black was large Carburizing and slag inclusion occurred |

TABLE 1(e)

| | Reference Example | |
|---|---|---|
| | [illegible] | [illegible] |
| Base material for slag | | |
| Portland cement | 47 | 47 |
| fly ash | [illegible]4 | [illegible]3 |
| silica flour | | |
| vitreous calcium silicate | | |
| soda glass | | |
| blast furnace slag | | |
| Flux | | |
| fluorite | [illegible]0 | |
| soda ash | [illegible] | |
| cryolite | | |
| sodium fluoride | | 5 |
| calcium carbonate | | |
| Carbonaceous aggregate | | |
| carbon black | [illegible].5 | |
| activated carbon | 4 | [illegible] |

TABLE 1(e)-continued

| | Reference Example | |
|---|---|---|
| | 6 | 7 |
| (particle size, μm) | (2) | (8) |
| Bulk density (g/cm$^3$) | 1.05 | 1.05 |
| Heat insulation on molten steel surface in mold | good | good |
| Carburizing degree | 1.0 | 1.0 |
| Index of slag inclusion | 0 | 0 |
| Remarks | Bulk density was unsuitable Carburizing occurred | Bulk density was unsuitable Carburizing occurred |

TABLE 2(a)

| | Comparative Example | |
|---|---|---|
| | 1 | 2 |
| Base material for slag | | |
| Portland cement | | 10 |
| fly ash | | 10 |
| silica flour | 9 | 5 |
| vitreous calcium silicate | | 54 |
| soda glass | 45 | |
| blast furnace slag | 18 | |
| Flux | | |
| fluorite | 3 | |
| soda ash | 5 | |
| cryolite | | 15 |
| sodium fluoride | 17 | |
| calcium carbonate | | |
| magnesium carbonate | | |
| Carbonaceous aggregate | | |
| carbon black | 2 | 1 |
| activated carbon | graphite 2 | 6 |
| (particle size, μm) | | (8) |
| BN | | |
| Bulk density (g/cm$^3$) | 0.80 | 0.80 |
| Heat insulation on molten steel surface in mold | good | good |
| Carburizing degree | 1.0 | 3.0 |
| Index of slag inclusion | 1.0 | 1.0 |
| Remarks | Inappropriate carbon kind Carburizing occurred | Amount of premelted base material was insufficient insufficient performance improvement |

Note:
The mold powder is granular in only Comparative Example 1.

TABLE 2(b)

| | Comparative Example | |
|---|---|---|
| | 3 | 4 |
| Base material for slag | | |
| Portland cement | 50 | 40 |
| fly ash | 25 | 24 |
| silica flour | 10 | 10 |
| vitreous calcium silicate | | |
| soda glass | | |
| blast furnace slag | | |
| Flux | | |
| fluorite | 10 | 10 |
| soda ash | 5 | 5 |
| cryolite | | |
| sodium fluoride | | |
| calcium carbonate | | |
| magnesium carbonate | | |
| Carbonaceous aggregate | | |
| carbon black | | |
| activated carbon | | |
| (particle size, μm) | | |
| BN | | 2 |
| Bulk density (g/cm$^3$ | 0.80 | 0.80 |
| Heat insulation on molten steel surface in mold | Deckel formed | Deckel formed |

TABLE 2(b)-continued

| | Comparative Example | |
|---|---|---|
| | 3 | 4 |
| Carburizing degree | 0 | 0 |
| Index of slag inclusion | 7.0 | 5.0 |
| Remarks | No carbonaceous aggregate Insufficient performance improvement (large slag inclusion | Inappropriate carbonaceous aggregate Insufficient performance improvement |

TABLE 2(c)

| | Comparative Example | |
|---|---|---|
| | 5 | 6 |
| Base material for slag | | |
| Portland cement | 49 | 48 |
| fly ash | 22 | 22 |
| silica flour | 10 | 10 |
| vitreous calcium silicate | | |
| soda glass | | |
| blast furnace slag | | |
| Flux | | |
| fluorite | 10 | 10 |
| soda ash | 5 | 5 |
| cryolite | | |
| sodium fluoride | | |
| calcium carbonate | | |
| magnesium carbonate | | |
| Carbonaceous aggregate | | |
| carbon black | 1.5 | graphite 3 CB 2 |
| activated carbon | | |
| (particle size, μm) | | |
| BN | 2 | |
| Bulk density (g/cm$^3$) | 0.80 | 0.80 |
| Heat insulation on molten steel surface in mold | Deckel formed | good |
| Carburizing degree | 0 | 3.0 |
| Index of slag inclusion | 4.0 | 0 |
| Remarks | Inappropriate carbonaceous aggregate Insuffieient performance improvement | Inappropriate carbon kind Carburizing occurred |

TABLE 2(d)

| | Comparative Example | |
|---|---|---|
| | 7 | 8 |
| Base material for slag | | |
| Portland cement | 48 | 35 |
| fly ash | 22 | 25 |
| silica flour | 10 | 5 |
| vitreous calcium silicate | | |
| soda glass | | |
| blast furnace slag | | |
| Flux | | |
| fluorite | 10 | 10 |
| soda ash | 5 | 5 |
| cryolite | | |
| sodium fluoride | | |
| calcium carbonate | | 10 |
| magnesium carbonate | | 10 |
| Carbonaceous aggregate | | |
| carbon black | coke 5 | |
| activated carbon | | |
| (particle size, μm) | | |
| BN | | |
| Bulk density (g/cm$^3$) | 0.80 | 0.80 |
| Heat insulation on molten steel surface in mold | good | Deckel formed |
| Carburizing degree | 3.0 | 0 |
| Index of slag inclusion | 0 | 4.0 |

TABLE 2(d)-continued

| | Comparative Example | |
|---|---|---|
| | 7 | 8 |
| Remarks | Inappropriate carbon kind Carburizing occurred | No carbonaceous aggregate (another carbonate was further added) large slag inclusion |

TABLE 3

| | Chemical composition (%) | | |
|---|---|---|---|
| | CaO | $SiO_2$ | $Al_2O_3$ |
| Portland cement | 65 | 23 | 5 |
| Fly ash | 5~8 | 60 | 15~20 |
| Silica flour | | 90 | |
| Vitreous calcium silicate | 50 | 45 | 3 |
| Soda glass | 8 | 71 | 3 |
| Blast furnace slag (water granulated) | 41 | 32 | 15 |

The evaluation was performed as follows:

(1) Thermal insulation on molten steel surface in mold:

The effect of the thermal insulation on the molten steel surface by the mold powder was determined by the visual observation based on the appearance of Decker in the mold.

(2) Carburizing degree:

The number per unit area of the carburized portions produced on the outermost surface of the cast slab, each portion having a carbon content larger by several times than that of the molten steel, was measured in order to evaluate the carburizing degree. The carburizing degree is expressed as a relative value taking the carburizing degree of Comparative Example 1 as 1.0.

(3) Index of slag inclusion:

The relative evaluation was carried out by taking the frequency of slag inclusion (number of slag inclusions per unit area of the cast slab) appeared in Comparative Example 2 shown in Table 2 as 1.0.

From the comparison of the data in Tables 1 and 2, it is obvious that at least one of the thermal insulation on the molten steel surface in the mold, the carburizing phenomenon, and the slag inclusion cannot be avoided in all of Reference Examples and Comparative Examples, while according to the invention, all of these defects can be satisfactorily prevented.

The reason why the carburizing phenomenon for molten steel, which is inevitable in the previously mentioned prior art using a combination of 0.4~0.9% of carbon black and 1.0~5.0% of coarse carbon powder with an average particle size of not less than 1 μm as a carbonaceous aggregate, is particularly avoided by the using a combination of 0.5–2.0% of carbon black and 1–4% of activated carbon with an average particle size of not more than 10 μm as a carbonaceous aggregate according to the invention is confirmed to be due to the fact that the sintered layer of the mold powder, which is apt to be formed in a relatively large thickness between the molten slag layer formed on the molten steel surface in the mold and the charged mold powder layer, is substantially prevented from being produced according to the invention, and that the mold powder is maintained on the molten slag layer through a thin semi-molten layer.

According to the invention, the thermal insulation on the molten steel surface in the mold can effectively and advantageously be realized without suffering the slag inclusion and the carburizing, and therefore, the invention is particularly useful for continuously casting low carbon steel.

What is claimed is:

1. In a mold additive for use in a continuous casting, which comprises a base material for slag having a chemical composition of $CaO—SiO_2—Al_2O_3$ system, a flux composed of at least one substance selected from the group consisting of fluorides and carbonates of alkali metals and alkaline earth metals, and a carbonaceous aggregate as a melting rate adjuster the improvement comprising, as said carbonaceous aggregate, carbon black and activated carbon having an average particle size of not more than 10 μm and in amounts of 0.5–2.0% by weight and 1–4% by weight, respectively, wherein the bulk density of the mold additive is not more than 0.9 g/cm$^3$.

2. A mold additive according to claim 1, wherein at least 60% by weight of a mixture of said base material and said flux are preliminarily melted before the mixing with the remaining portion of said mixture.

3. A mold additive according to claim 1, wherein said flux is selected from the group consisting of $CaF_2$, $BaF_2$, NaF, LiF, $Na_2CO_3$, $K_2CO_3$, $Li_2CO_3$, $CaCO_3$ and $BaCO_3$.

4. A mold additive according to claim 1, wherein said flux is added in an amount of 5–30% by weight based on the whole of the mold additive.

5. A mold additive according to claim 1, wherein said carbon black has a particle size of 0.01~0.05 μm and a specific surface area of 50–240 m$^2$/g.

* * * * *